United States Patent [19]

Gilano et al.

[11] 4,156,802

[45] May 29, 1979

[54] ELECTRICAL SWITCH ASSEMBLY

[75] Inventors: Michael N. Gilano, Newport Beach; James C. Hayes, Irvine, both of Calif.

[73] Assignee: Telaris Telecommunications, Inc., Irvine, Calif.

[21] Appl. No.: 844,598

[22] Filed: Oct. 25, 1977

Related U.S. Application Data

[63] Continuation-in-part of Ser. No. 805,347, Jun. 10, 1977, Pat. No. 4,117,292.

[51] Int. Cl.[2] ..... H01H 13/70

[52] U.S. Cl. ..... 200/5 A; 200/159 B; 200/275; 200/292; 200/330; 200/340

[58] Field of Search ..... 200/5 A, 159 B, 275, 200/302, 338, 340, 330, 292

[56] References Cited

U.S. PATENT DOCUMENTS

| | | | |
|---|---|---|---|
| 3,383,487 | 5/1968 | Wiener | 200/302 |
| 3,582,594 | 6/1971 | Twyford | 200/340 |
| 3,773,997 | 11/1973 | Evans et al. | 200/330 X |
| 3,773,998 | 11/1973 | Seeger, Jr. et al. | 200/159 B |
| 3,777,090 | 12/1973 | Muller | 200/330 X |
| 3,856,998 | 12/1974 | Sims, Jr. | 200/340 X |
| 3,911,234 | 10/1975 | Kotaka | 200/159 B X |
| 3,932,722 | 1/1976 | Obata et al. | 200/340 |
| 3,993,884 | 11/1976 | Kondur et al. | 200/295 |
| 4,002,892 | 1/1977 | Zielinski | 200/292 |
| 4,066,851 | 1/1978 | White et al. | 200/340 X |
| 4,117,292 | 9/1978 | Hayes et al. | 200/340 |

*Primary Examiner*—James R. Scott

*Attorney, Agent, or Firm*—Fraser and Bogucki

[57] ABSTRACT

An inexpensive, yet highly reliable, electrical switch contact assembly with excellent human factors considerations includes an electrical contact assembly having a plurality of switch positions, a cover plate disposed adjacent the switch contact assembly with an aperture for each switch position, and at each switch position an apertured key, a follower disposed within the key aperture, a cap containing the follower within the key aperture and key and follower springs biasing the key and follower respectively to provide separate and independent control over key actuation and switch contact closure forces. A contact engagement post of the follower may be accurately positioned above a switch contact notwithstanding variations in spring characteristics an a curvilinear engagement surface assures optimum distributed switch closure pressure for high reliability switch actuation. Switch contact patterns with oppositely disposed and interdigitated circularly and radially extending portions assure the security of multiple switch closure engagements.

24 Claims, 4 Drawing Figures

FIG. 1
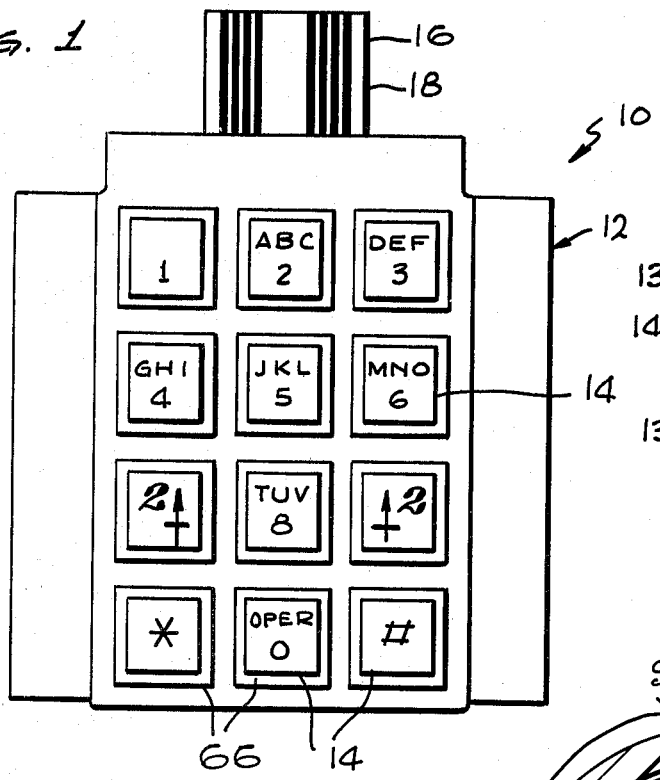
FIG. 5
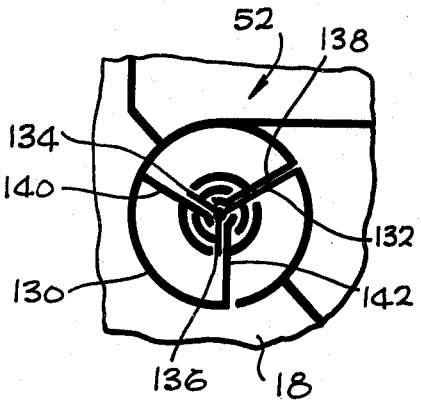
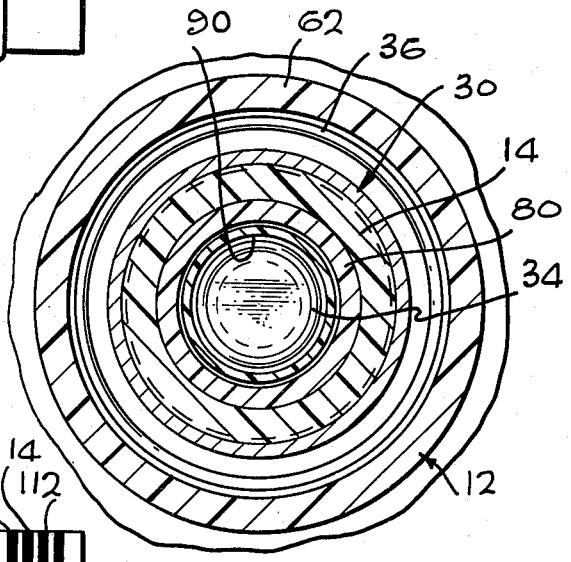
FIG. 3
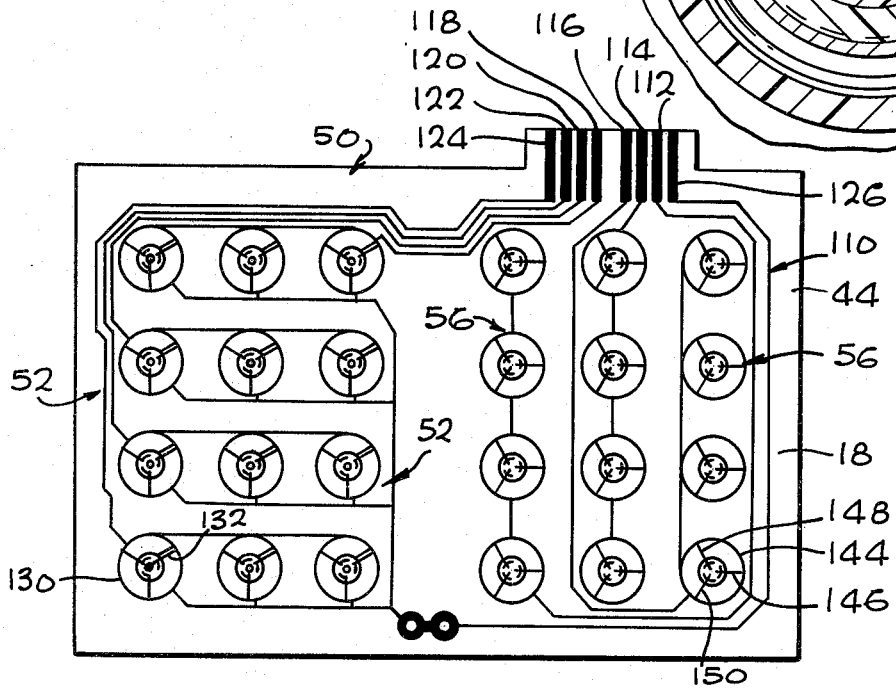
FIG. 4

ELECTRICAL SWITCH ASSEMBLY

CROSS REFERENCE TO RELATED APPLICATION

This application is a continuation-in-part of application Ser. No. 805,347, filed June 9, 1977, now U.S. Pat. No. 4,117,292, titled "DUAL SPRING ACTUATOR FOR KEYBOARD SWITCH ASSEMBLY," by Gilano et al and assigned to the assignee of this application.

BACKGROUND OF THE INVENTION

1. Field of the Invention

This invention relates to pushbutton key switch assemblies and more particularly to such assemblies using multi-spring actuators for each switch position.

2. Discussion of the Prior Art

Low cost, highly reliable key switch assemblies are required for many applications such as push button telephone keyboards and calculator keyboards. While many improvements have been made in key switch assemblies in recent years, such assemblies represent a significant cost or failure factor in many high volume products and further improvements are of great importance.

It is known to provide batch fabricated contact sets and switch actuators with independent spring biasing of key actuation and switch closure forces. However, the extreme precision, low cost and high reliability provided by switch contact assemblies in accordance with the present invention is not previously known.

For example, a single spring actuator arrangement is taught in U.S. Pat. No. 3,783,205 to Boulanger. The single spring of course fails to provide independent control over key actuation and contact closure forces, or precise control over the key position for switch closure notwithstanding normal tolerances in switch components. U.S. Pat. No. 3,780,237 to Seeger, Jr. et al, U.S. Pat. No. 3,856,998 to Sims, Jr. and U.S. Pat No. 3,993,884 to Kondur et al all teach dual spring key actuator arrangements. However, these arrangements do not provide the combination of precision, repeatability, and switch closure security that is attainable with a switch assembly in accordance with the present invention. For instance, only the patent to kondur et al teaches positioning of the follower, but assembly is quite complex with many latches, catches and washers and cannot be accomplished from a single side. None of these references teach the advantages of combining a dual spring actuator with a third spring comprised of a truncated cone contact or the contact configuration of this invention.

Disclosure of switch contact assemblies can be found in U.S. Pat. Nos. 3,383,487 to Weiner, 3,699,294 to Sudduth and 3,860,771 to Lynn et al. However, the combination of simplicity, cone spring switch contact assembly, high security circuit pattern and excellent actuator assembly taught by this application are not disclosed.

SUMMARY OF THE INVENTION

A highly reliable, yet low cost, key switch assembly in accordance with the invention includes a generally planar batch fabricated switch contact assembly and a switch actuator assembly. The switch contact assembly includes a plurality of switch positions arranged in rows and columns and includes a substrate that is folded about an apertured spacer to define opposed first and second contact sets at each switch position. The spacer has an aperture at each switch position through which the second contact set may be extended in response to a switch actuation force. Each first contact set includes interdigitated row and common conductors arranged as circularly and radially extending pairs. The row conductors for each row are connected together and all of the common conductors are connected together.

A planar actuator layer supports a second contact set including a protruding "bubble" at each switch position which is preferably configured as a cone shaped spring. Each second contact set includes a circularly extending ring and radially extending conductors disposed for switch closure engagement with radially extending and circularly extending respectively pairs of row and common conductors of a mating first contact set. Cone spring flexure, resilience and longevity is maintained even with metal conductors by providing at least three discontinuities in circumferentially extending portions of the second contact set within the cone flexure region and by avoiding a conductive center or hub interconnecting the radially extending conductors of the second contact set. However, the radially extending conductors for a contact set are interconnected peripherally of the flexure region and columns of second contact sets are interconnected. Thus, regardless of the angle variation of an actuator, switch closure results in multiple electrical interconnection of row, column and common conductors at an actuated switch position to assure a definite, secure and long life switch closure mechanism.

The switch actuator assembly includes a generally planar cover plate disposed adjacent the switch contact assembly with a key receiving and guiding aperture opposite each switch position. The plate apertures each extend along a central axis perpendicular to the switch contact assembly and receive an apertured key which may slide along the central axis between a first, nonactuated, limit and a second, actuated, limit. The apertured key receives in sliding, guiding relationship a follower, a follower spring and a cap for securing the follower and spring. The follower is secured at a fixed, nonactuated limit relative to the key and includes a post extending through the key for actuation engagement with a switch contact "bubble". A spherical configuration of the post about a center of wobble insures a good, distributed pressure engagement of the post with the contact set notwithstanding off center actuation of the key. A key biases the key toward a nonactuated first limit which permits precise, positive positioning of the post spherical end in spaced relation to the contact set cone spring.

The truncated cone shaped spring 46 serves to space the conductive contacts from each other, to provide a spring action which, in combination with the follower spring, establishes a selectable range of keystroke travel for closure and to provide an avalanche characteristic wherein more force is required to collapse the cone initially than to maintain the cone in a collapsed or actuated state. The cone spring and follower spring thus cooperate to yield a beneficial result that might be termed force-position hysteresis. The spring 46 may be formed in a die with the material, material thickness, die temperature, die pressure and die formation time chosen to provide a selected actuation force from a broad range to control factors such as key travel before closure.

Excellent human factors switching characteristics are attained by making the post spacing about half the key travel distance. The dual spring arrangement permits the key spring to provide a desired return force while the follower spring exerts a selected actuation force on a contact set cone spring. With nonactuated follower spring force slightly less than cone spring actuation force, but greater than maintenance force, an excellent tease free, force-distance hysteresis characteristic is attained in which a closed switch cannot be opened without at least some retreat of the actuating key toward the first nonactivated limit.

BRIEF DESCRIPTION OF THE DRAWINGS

A better understanding of the invention may be had from a consideration of the following detailed description taken in conjunction with the accompanying drawings, in which:

FIG. 1 is a plan view of a keyboard in accordance with the invention;

FIG. 3 is a sectional plan view of a switch position of the switch assembly shown in FIG. 1 taken along line 3—3 of FIG. 2; and FIG. 4 is a plan view of a printed circuit switch contact array in accordance with the invention.

DETAILED DESCRIPTION

Figure 2:
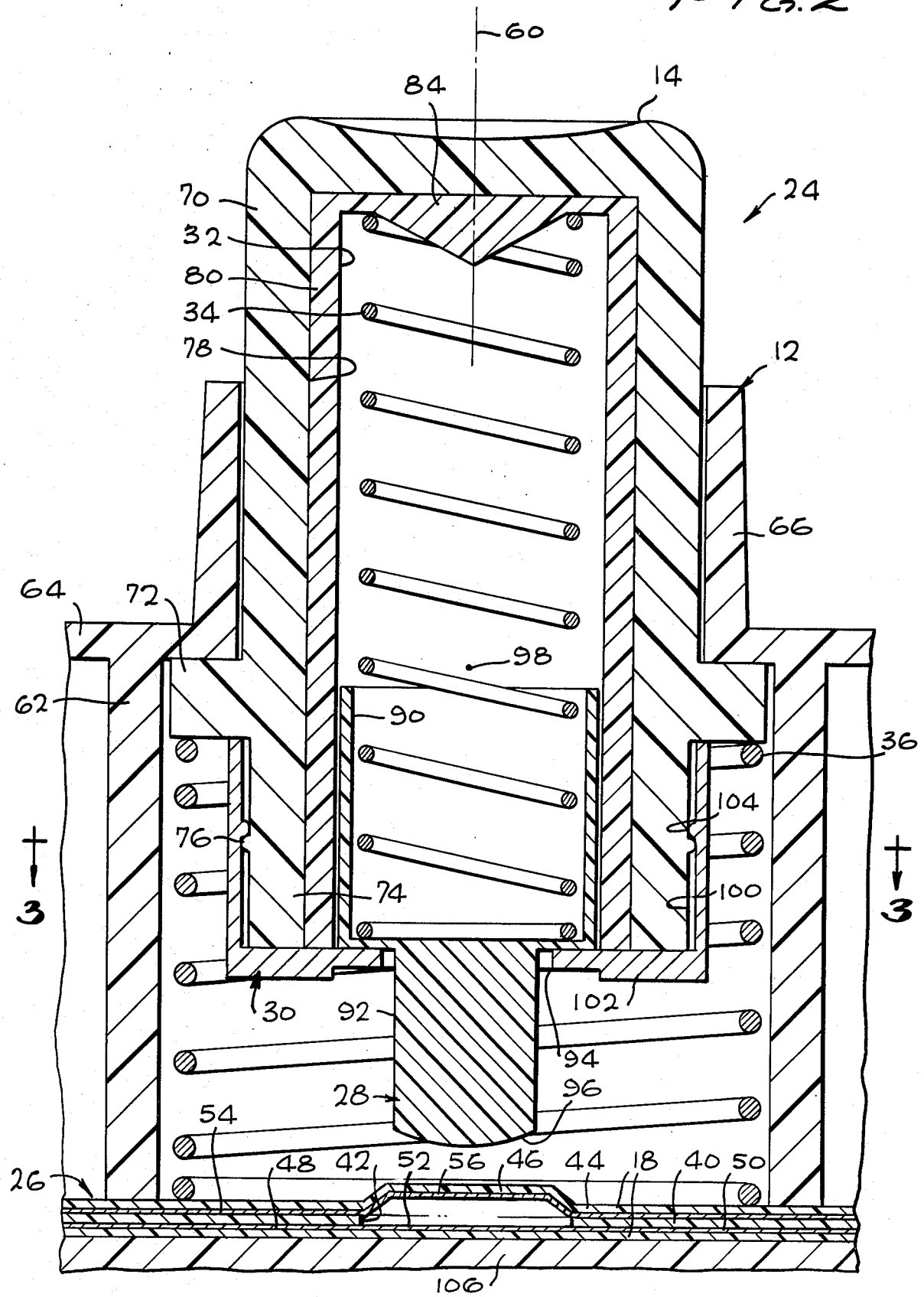
FIG. 2 is a sectional side view taken along line 2—2 of FIG. 1.

Referring now to FIG. 1, a key switch assembly in accordance with the invention includes a cover plate 12 supporting and guiding an array of actuator keys 14, each located at a different switch position and arranged to provide four rows and three columns of pushbutton switches. A connector portion 16 of a folded switch contact substrate 18 extends from the switch assembly 10 to provide a convenient electrical connection to external circuitry.

Making further reference now to FIGS. 2 and 3, a typical switch position is shown as including a key actuator assembly 24 and a key contact assembly 26. The key actuator assembly 24 includes, in addition to actuator key 14, and a portion of cover plate 12, a follower 28, a cap 30 securing follower 28 within a central key aperture 32 within key 14, a helical coil follower spring 34 disposed in compression to force follower 28 downwardly relative to key 14, and a helical coil key spring 36 disposed in compression to force key 14 upward relative to key contact assembly 26. The key contact assembly 26 includes the flexible substrate 18 folded about a spacer 40 having a central aperture 42 extending therethrough at each switch position. The substrate 18 includes an upper planar layer 44 with upwardly extending truncated cone protrusions forming springs 46 defined as an integral part thereof. A lower planar layer portion 48 of substrate 18 is disposed in opposed, spaced apart, facing relationship to upper planar layer 44 and carries a first conductive switch closure contact circuit pattern 50 defining a first contact set 52 within the periphery of aperture 42. Similarly, upper planar layer 44 carries an upper conductive circuit pattern 54 having a second conductive switch closure contact circuit pattern 56 disposed in opposed, mating, switch closure relationship to the first contact set 52. Upon the application of an actuation force to cone spring 46, the cone spring 46 is forced downwardly to snap through center and cause upper contact set 56 to physically engage lower contact set 52 to provide electrical switch closure. Upon reduction of the actuation force below a switch closure maintenance force less than the actuation force, the cone spring 46 again snaps upwardly to return to its original unactuated condition as shown in FIG. 2.

The key 14 and follower 28 slide along a central axis 60 which extends perpendicular to the switch contact assembly 26. Cover plate 12 guidingly receives key 14 and includes a lower cylindrical portion 62 adjacent contact assembly 26, a flange 64 which extends inwardly from lower cylindrical portion 62 at a position spaced apart from contact assembly 26 and an upwardly extending flange 66 which is generally rectangular in cross section and provides additional guidance and support for key 14 as it slides along axis 60.

Actuator key 14 has a generally rectangular upper portion 70 which mates with flange 66, a generally cylindrical radially outward extending flange 72 just below upper portion 70 and a lower cylindrical portion 74 which extends from flange 72 to the bottom of the key. Flange 72 engages flange 64 of cover plate 12 to provide a first or upper limit of sliding key travel for actuator key 14. Key 14 also has a circumferentially extending protrusion 76 in the outer surface of cylindrical portion 74 and a central aperture 78 which receives a bushing 80 having defined therein the central key aperture 32. Bushing 80 has at an uppermost end thereof a convex conical shaped protrusion 84 which receives and guides follower spring 34. It will be appreciated that actuator key 14 may be fabricated as a single integral element without need for internal bushing 80.

Internal key aperture 32 receives in sliding, guiding relationship the follower 28 having an upper hollow cylindrical portion 90 and a downwardly extending solid cylindrical post 92. Post 92 extends downwardly through a central aperture 94 in retainer cap 30. The switch contact engaging end 96 of post 92 has a spherical surface shape defined about a center of wobble 98 of follower 28 and key 14. The actuator key 14 may not be pushed exactly along central axis 60 by an operator and because of required tolerance spaces between actuator key 14 and cover plate 12 and between follower 28 and actuator key 14, the follower 28 may wobble somewhat and engage the cone spring 46 other than perpendicularly along central axis 60. The curvilinear spherical surface 96 assures that notwithstanding this wobble, a smooth even pressure is distributed against cone spring 46 near the center thereof to assure secure switch closure contact.

The size and shape of post 92 may be selected to provide desired switch closure characteristics. Force-position hysteresis and a feeling of detent tend to be maximized by a flat end and a large diameter of post 92 which is approximately coextensive with the disk shaped top surface or truncation of a spring 46. These characteristics tend to be lessened by a rounded surface 96 and by a decreased diameter of post 96. A flat bottomed post 96 with a diameter about half the diameter of the flat disk shaped top of a cone spring 46 provides a good compromise between hysteresis and detent, wide area multi-point switch contact and switch reliability notwithstanding wobble during actuation.

Retainer cap 30 has a hollow cylindrical portion 100 which slidingly receives cylindrical portion 74 of key 14 and a flat disk-shaped portion 102 which forms the bottom of cap 30, engages the bottom of key 14, and engages a bottom of cylindrical portion 90 of follower 28 to constrain follower 28 within central key aperture 82 and define a downwardmost limit for sliding motion of follower 28 relative to key 14. Inwardly extending protrusions 104 are provided on the interior surface of cylindrical portion 100 to engage outwardly extending circumferential protrusion 76 and maintain retainer cap 30 in assembled position relative to key 14.

A back plate 106 supports the substrate 18 and is suitably attached to cover plate 12. Plate 106 assures a rigid back support against the relatively thin and flexible substrate 18.

Flange 72 engages flange 64 to position actuator key 14 at a first or upper limit in predetermined spaced relationship to contact assembly 26 when not actuated. In addition, retainer cap 30 serves in conjunction with compression follower spring 34 to position follower 28 at a fixed nonactuated position relative to key 14. The end 96 of post 92 may thus be precisely positioned at a preferred distance of about 50 mils above cone spring 46 notwithstanding normal tolerance variations in key spring 36 and follower spring 34. This 50 mil spacing of the end 96 represents slightly less than half of the total 125 mil travel distance available to actuatory key 14. In the rest condition, it is found desirable for the force on follower spring 34 to be slightly less than the approximately 100 grams required to depress cone spring 46 and somewhat greater than the 60 grams required to maintain cone spring 46 in an actuated condition after depression. A nominal standby force of 80 grams is thus selected for the unactuated compression force of follower spring 34. Thus, upon key actuation, key 14 travels a considerable distance before surface 96 engages cone spring 46 and must travel a short additional distance before the actuation force provided by follower spring 34 is sufficient to exceed 100 grams and depress cone spring 46. The spring constant of 3 lbs. per inch of follower spring 34 is selected to require an additional travel distance a little bit greater than the thickness of spacer 40 which might typically be a few mils. Therefore, as cone spring 46 snaps through center, the follower 92 can extend downwardly within key 14 to maintain a continuous actuation force against cone spring 46 greater than the 60 gram maintenance force even though the snap action of cone spring 46 may cause it to move faster than the motion of key 14. A single, low bounce continuous switch closure is thus attained and maintained until actuator key 14 retreats toward the nonactuated first limit.

As actuator key 14 is further depressed toward a second, actuated limit, in which cap 30 engages the top surface of top planar layer 44, follower spring 34 continues to depress somewhat with the actuation force being only slightly increased. As a result, even though an operator may exert a large force against actuator key 14, only the much smaller maximum force exerted by follower spring 34 is communicated against cone spring 46 as an actuation force. The engaging first and second sets of contacts 52, 56 are thus shielded from any excessive force that might cause rapid wear or damage to the contacts. At the same time, key spring 36 exerts an independent upward force against actuation key 14 as it extends in compression between flange 72 and upper planar layer surface 44 to provide a desired return force which may be substantially greater than the desired minimal actuation force actually exerted on cone spring 46. The operator human factors consideration may thus be defined independently of the quite different switch actuator considerations. A highly reliable switch with excellent operator "feel" thus results.

Referring now to FIG. 4, where substrate 18 is shown unfolded with upper planar surface 44 on the right and lower planar surface 50 on the left, it will be observed that a conductive pattern 110 defined on substrate 18 defines a conductive circuit pattern which connects a first column of second switch closure contact sets 56 to a terminal 112, a second column of second switch closure contact sets 56 to a terminal 114, and a third column of second switch closure contact sets 56 to a terminal 116. In similar manner, the first through fourth rows of first switch contact sets 52 are coupled respectively to terminals 118, 120, 122 and 124 respectively. The common conductor which is provided at each of the first contact sets 52 is coupled to a terminal 126.

Referring by way of example to the switch contact sets 52, 56 at row 4, column 3 and making further reference to FIG. 5, it will be observed that a radially outward circle 130 is defined approximately $\frac{2}{3}$ by a row four conductor and $\frac{1}{3}$ by the common conductor. The common conductor has a line 132 which extends radially inward from the outer circle 130 to the center and additional radially extending conductors 134, 136 which extend radially outward from the center with an included angle of approximately 120° between line 132 and themselves. The fourth row conductor has three lines 138, 140 and 142 which extend radially inward from outer circle 130 toward the center in parallel closely spaced relationship to lines 132, 134 and 136 respectively without making actual contact with the common conductors. Within a contact region near the center of the outer circle 130, the row and common conductors also form four closely spaced concentric circular patterns with the common conductor defining a first solid circular pattern at the center, and a third circular pattern radially outward therefrom. The row conductor defines a second circular pattern between the first and third circular patterns and a fourth circular pattern radially outward of the third circular pattern. Thus, at each switch position the row and common conductors define two pairs of radially extending adjacent or interdigitated conductors and two pairs of circularly extending adjacent or interdigitated conductors.

At each second contact set 56 the column conductor defines an outer circle 144 which upon folding of substrate 18 aligns itself in opposed facing relationship to outer circle 130. These circles 130 and 144 extend about the periphery of an aperture 42 of spacer 40 to assure that within a switch position, the switch conductors as well as the substrate 18 are spaced apart by the thickness of spacer 40. Three lines 146, 148, 150 extend radially inward from outer circle 144 toward the center of circle 144 without actually reaching the center. Each of these lines further extends circumferentially at a radial distance within the radial extremities of shorter lines 134 and 136 to define three nontouching segments of a circle. The lines 146, 148 and 150 are angularly disposed so as to align themselves between the radially extending lines of the first switch contact set and assure their positioning in opposed relationship to the interdigitated pairs of circularly extending contacts of the first contact set. Similarly, the circularly extending portions of the second contact set are disposed to insure their engagement with the radially extending portions of the first contact set. Therefore, the multiple radial and circularly extending interdigitated pairs of the first contact set and the mating circularly and radially extending respectively conductors of the second contact set insure a multiple contact closure engagement upon depression of a cone spring 46 which insures that at least one set of contacts remains closed notwithstanding any wobble and hence deviation from center of the follower 28. An extremely reliable and secure multiple switch contact closure is thus attained in a switch contact assembly 26 which is relatively simple and inexpensive to manufacture.

The separate radially and circularly extending lines 146, 148 and 150 of the second contact set assure that the cone spring 46 retains a maximum flexibility and resiliency notwithstanding the printing of metal conductors thereon. The metal conductors do not have the resiliency of the planar layer 44 and cone spring 46 and thus tend to initiate spring return after actuation. However, it will be appreciated that in the event that the conductors are formed from a somewhat more flexible material, such as organic materials applied by silk screening processes, more conductive material can be used in each second contact set 56 and the entire portion of the inner surface of a cone spring radially inward of the circularly extending conductor portions can become a solid conductive disk.

While there has been shown and described a particular arrangement of a key switch assembly in accordance with the invention for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

What is claimed is:

1. A switch assembly comprising:

a switch contact assembly having a plurality of switch contact sets disposed at switch positions along a plane, each contact set being selectively closeable in response to a switch actuation force at a switch position;

a cover plate disposed in opposed relationship to the switch contact assembly and having opposite each switch position a plate aperture adapted to slideably receive a key and guide the key as it slides between first and second limits;

a plurality of keys, each slideably disposed in a different plate aperture to slide between first and second limits, each key having a central key aperture adapted to slideably receive and guide a follower;

a plurality of key springs, each disposed to bias a different key away from the switch contact assembly toward a non-activated position;

a plurality of followers, each slideably disposed within the key aperture of a different key and having a post extending beyond the key aperture and toward a switch contact set;

a plurality of follower springs, each disposed within a key aperture of a different key to bias a follower therein toward a contact set relative to the key; and a plurality of caps, each secured to a different key and retaining a follower within a key aperture in a manner permitting the post of the retained follower to extend beyond the key aperture and toward a switch contact set.

2. The switch assembly according to claim 1 above, wherein the cover plate has an inwardly projecting flange at each plate aperture that partially closes the aperture at a position spaced apart from the switch contact assembly.

3. The switch assembly according to claim 2 above, wherein each key includes an outwardly projecting flange which slides in mating, guiding relationship with a plate aperture and engages an inwardly projecting flange of the plate to provide the first limit.

4. The switch assembly according to claim 3 above, wherein the cover plate includes for each plate aperture a guide flange extending perpendicular to the inwardly projecting flange at an inwardmost position thereof.

5. The switch according to claim 3 above, wherein each key spring is a helical coil spring that remains in compression at all times between the switch contact assembly and an outwardly projecting flange of a key associated therewith.

6. The switch assembly according to claim 3 above, wherein each follower spring is a helical coil spring disposed in compression between a follower and a key associated therewith.

7. The switch assembly according to claim 6 above, wherein each cap engages an associated follower to maintain the follower at a predetermined limit position relative to the key when the key is not actuated and at the first limit.

8. The switch assembly according to claim 7 above, wherein the outwardly projecting flange of each key is disposed to maintain the key associated therewith at a first limit position at which the post of an associated follower is spaced apart from a switch contact set opposite thereto.

9. The switch assembly according to claim 8 above, wherein the length and spring constant of each follower spring is selected to provide a force against an associated follower in the nonactuated limit position less than the force required to actuate a switch contact set opposite thereto and a spring constant strong enough for the force applied to the follower to exceed the contact actuation force when the follower slides relative to the key a distance slightly greater than the motion distance of a switch contact set upon closure.

10. The switch assembly according to claim 9 above, wherein the switch contact actuation force is approximately 100 grams, wherein the follower spring force at a nonactuated limit position is approximately 80 grams, and wherein the spring constant of the follower spring is approximately 3 pounds per inch.

11. The switch assembly according to claim 10 above, wherein the switch contact retention force required to maintain each set of switch contacts in an actuated condition after actuation is less than the switch contact actuation force therefor.

12. The switch assembly according to claim 11 above, wherein the switch contact retention force for each set of switch contacts is approximately 60 grams.

13. The switch assembly according to claim 1 above, wherein the post of each follower has a curvilinear end disposed for engagement with a switch contact set.

14. The switch assembly according to claim 13 above, wherein the post of each follower has a spherical end disposed for engagement with a switch contact set, the spherical end having a center of curvature at a point of wobble of the follower relative to the switch contact assembly as the spherical end engages a switch contact set.

15. The switch assembly according to claim 1 above, wherein the switch contact assembly includes a substrate having a first contact set disposed thereon with first contacts provided at each of a plurality of switch positions, a planar actuator layer with a second contact set disposed thereon which includes second contacts provided at each switch position, and a spacer disposed between the substrate and actuator layer, the spacer having an aperture therethrough at each switch position to permit a second contact set to pass therethrough and into switch closure engagement with a first contact set in response to a switch actuator force provided by a follower.

16. The switch assembly according to claim 15 above, wherein the substrate and planar actuator layer are different parts of a single circuit carrier that is folded about the spacer.

17. The switch assembly according to claim 15 above, wherein the switch positions are arranged in an array having rows and columns and wherein the first contact set includes at each switch position a first contact pattern having interdigitated row and column conductor portions each having circularly extending portions and radially extending portions, the row conductor portions for each row of switch positions being electrically connected and the column conductor portions for each switch position being electrically connected, and wherein a third contact set includes at each switch position a common conductor defining a third contact pattern having radially extending portions and circularly extending portiions, the third contact patterns being electrically connected with electrical contact patterns for other switch positions.

18. The switch assembly according to claim 17 above, wherein the first contact pattern comprises at each switch position an outer ring defined partially by a row conductor and partially by a column conductor, the outer ring being larger than the aperture through the spacer at the switch position, a plurality of interdigitated inner rings defined by the row and column conductors, and a plurality of radially extending row and column conductor portions, each extending radially in adjacent pairs in the region of the inner rings.

19. The switch assembly according to claim 18 above, wherein the second contact pattern for each switch position includes an outer ring of a first contact pattern, an inner ring disposed for mating, contact engagement with radially extending portions of the first contact pattern; and a plurality of radially extending portions disposed for mating contact engagement with circularly extending portions of the first contact set.

20. A switch assembly comprising a plurality of switch positions arranged in rows and columns, each switch position including a first contact set including interdigitated row conductors, each arranged with a plurality of circularly extending portions and a plurality of radially extending portions extending between the circularly extending portions, the row conductors for each row of switch positions being interconnected, and including a second contact set disposed in normally spaced, opposed relationship to the first contact set, the second contact set having circularly extending portions disposed for contact closure engagement with radially extending portions of the first contact set and radially extending portions disposed for switch contact closure engagement with circularly extending portions of the first contact set, the second contact sets for each different column of switch positions being electrically connected.

21. The switch assembly according to claim 20 above, wherein each switch position further includes a third contact set including a common conductor with a plurality of circularly extending portions and a plurality of radially extending portions arranged in interdigitated relationship with the circularly and radially extending portions respectively of the first contact set.

22. The switch assembly according to claim 21 above, wherein the common conductors at each switch position are electrically connected together.

23. A switch assembly comprising:

a switch contact assembly having a plurality of switch positions at which a plurality of switch contacts are selectively closed in response to a switch actuator force; and a switch actuator assembly having a plurality of switch actuators disposed to apply a switch actuation force to a different switch position, and a cover plate disposed adjacent the contact assembly in opposed relationship thereto, the cover plate having a key aperture therethrough opposite each switch position which is adapted to receive and guide a key actuator sliding within the key aperture, the actuator assembly further including a plurality of key actuators, each key actuator being disposed within a different key aperture and each key actuator including a key disposed to slide within a key aperture, the key having a central concavity adapted to receive and guide a follower, each follower having a body portion slidingly disposed within the central concavity and a post extending toward a switch position and a retainer cap disposed to contain the body portion of the follower within the central cavity, a key spring disposed to bias the actuator assembly away from the contact assembly and a follower spring disposed to bias the follower toward the contact assembly relative to a key within which it is received.

24. The switch assembly according to claim 23 above, wherein each contact set includes a truncated cone shaped spring disposed to oppose a switch closure force exerted by a follower, the truncated cone shaped spring opposing the switch closure force to a given force magnitude at which an avalanche collapse occurs resulting in the truncated cone shaped spring being maintainable in a collapsed state by a switch closure force less than the given force.

* * * * *

UNITED STATES PATENT AND TRADEMARK OFFICE

CERTIFICATE OF CORRECTION

PATENT NO. : 4,156,802

DATED : May 29, 1979

INVENTOR(S) : Michael N. Gilano and James C. Hayes

It is certified that error appears in the above-identified patent and that said Letters Patent are hereby corrected as shown below:

Column 1, line 7, after "June" and before ", 1977", "9" should read --10--; line 46, after "to" and before "et al", "kondur" should read --Kondur--. Column 3, line 34, after "provide" and before "convenient" strike "a".

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*